United States Patent [19]

Nubani et al.

[11] 4,031,597

[45] June 28, 1977

[54] METHOD OF ASSEMBLING A MOUNT ASSEMBLY IN THE NECK OF A CATHODE-RAY TUBE

[75] Inventors: Jawdat Ibrahim Nubani, Clarks Summit; Walter Robert Rysz, Moosic, both of Pa.

[73] Assignee: RCA Corporation, New York, N.Y.

[22] Filed: Sept. 22, 1976

[21] Appl. No.: 725,583

[52] U.S. Cl. ..... 29/25.16; 29/25.15; 427/68; 427/155

[51] Int. Cl.[2] ..... H01J 9/18

[58] Field of Search ..... 29/25.13, 25.15, 25.16; 427/68, 106, 154, 155

[56] References Cited

UNITED STATES PATENTS 3,573,950 4/1971 Domicone ..... 425/154

*Primary Examiner*—Richard B. Lazarus
*Attorney, Agent, or Firm*—E. M. Whitacre; G. H. Bruestle; L. Greenspan

[57] ABSTRACT

During mount sealing, prior to sliding the mount assembly into the glass neck of a cathode-ray tube, the inner surface of the neck is coated with a film of volatilizable, organic material. Then, the mount assembly is slid into position and sealed in the neck. After sealing, the film is volatilized. Preferably, the film is thin, and the material is volatilizable when heated in air at temperatures below about 400° C, so that it is easily removable by baking in the usual tube-making processes.

8 Claims, 4 Drawing Figures

Fig. 1.
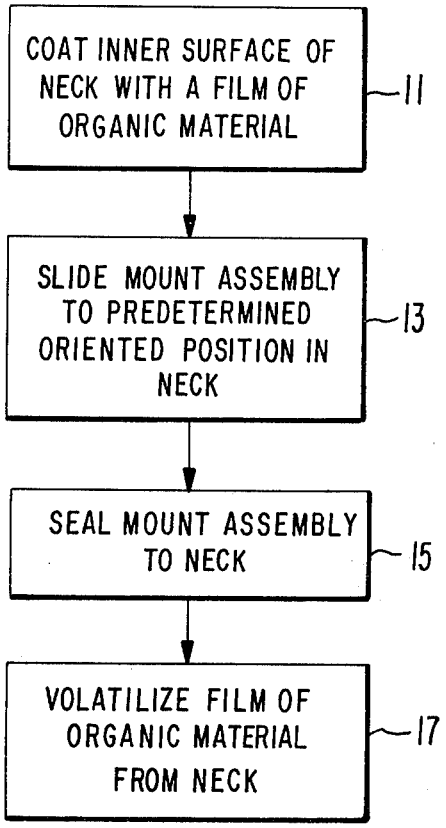
Fig. 4.
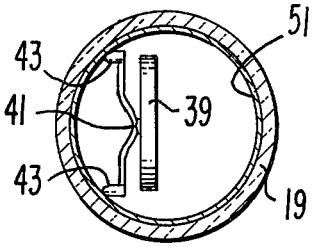
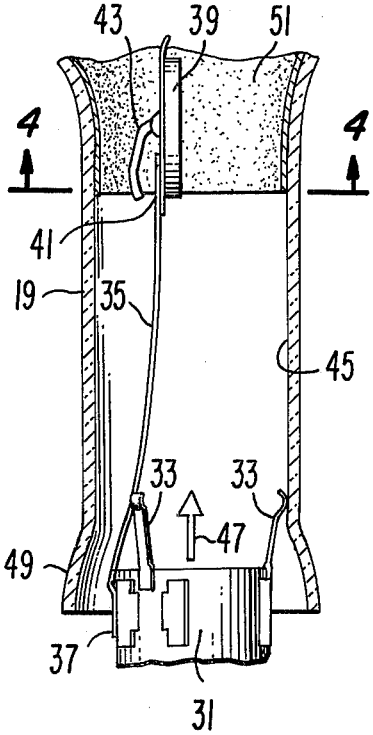
Fig. 3.
Fig. 2.
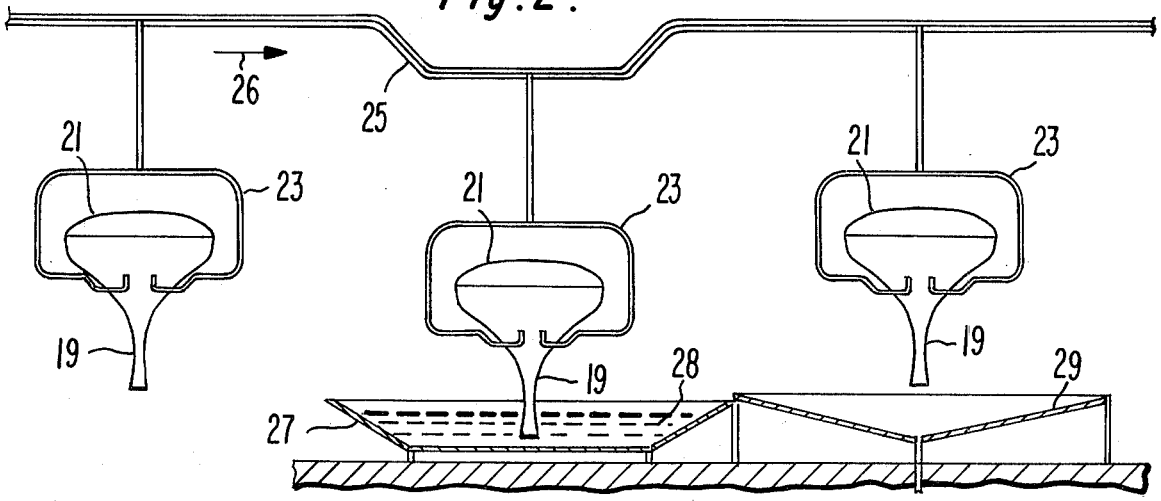

METHOD OF ASSEMBLING A MOUNT ASSEMBLY IN THE NECK OF A CATHODE-RAY TUBE

BACKGROUND OF THE INVENTION

This invention relates to a novel method of assembling the mount assembly in the neck of a cathode-ray tube.

Most cathode-ray tubes are used for displaying video images; for example, in displays for television, radar and computer systems. A tube used for such applications includes a bulb or envelope comprising a faceplate panel having a viewing window which supports a luminescent screen on its inside surface, a neck which houses and supports a mount assembly, and a funnel which connects the neck with the panel. During fabrication, the screen, window and funnel are assembled, and then the mount assembly, which includes a disc-shaped glass stem, is sealed into the neck. This latter step is referred to as mount sealing.

The mount assembly includes at least one electron gun which generates and projects at least one electron beam toward the screen for exciting the screen to luninescence when the tube is operating. The mount assembly may include also snubbers or bulb spacers, which are springlike fingers, at the opposite end of the mount from the stem for spacing the mount assembly from the neck. The mount assembly may also include an antenna getter which comprises a getter container attached to one end of a long, flat spring, which in turn is attached at its other end to the mount assembly. The spring urges the container against the inside of the funnel.

The funnel is coated on most of its inside surface with an electrically-conducting coating, usually including graphite and a binder therefor. The inside funnel coating extends under the getter container and under the bulb spacers down to the electron gun or guns. The inside neck surface opposite the guns is usually bare glass, but sometimes part or all of the surface has an electrically-resistive coating thereon.

During mount sealing, the panel-funnel assembly; that is, the assembled panel, screen, funnel, inside funnel coating and neck, is positioned in a holder. The antenna getter and bulb spacers are depressed and inserted by hand inside and near the open end of the neck. Then, the stem leads and stem are seated on a mount pin, and the mount assembly is rotationally oriented with respect to the screen. Now, the mount assembly is slid in the neck toward the screen to the desired spacing from the screen while maintaining its rotational orientation. Mount sealing is described previously; for example, in U.S. Pat. Nos. 3,807,006 to J. F. Segro et al and 2,886,336 to C. G. Reynard.

During the steps of inserting and sliding the mount assembly toward the screen, the getter container and the bulb spacers slide first on the bar glass surface of the neck and then on the inside funnel coating. It is believed that particles are liberated during this step, and in some cases the parts bind on the glass surface and/or funnel coating and scratch the surface beneath. Any particles which are generated are undesirable in the tube, since they may cause a variety of problems in the operation of the completed tube. Conducting particles, particularly in the neck region, may provide sites from which high-voltage arcing may occur. Insulating particles, wherever they exist in the tube, provide sites on which electrostatic charge can accumulate, producing localized electrostatic fields which may interfere with the cathode-ray beam or beams. Also, scratches on the bare glass may result in breakage of the glass during subsequent thermal cycling.

SUMMARY OF THE INVENTION

In the novel method of mounting sealing, the inner surface of the neck is coated with a film of volatilizable organic material, such as polyvinyl alcohol. Then, the mount assembly is inserted into the neck, slid to its predetermined oriented position therein, and sealed to the neck. After sealing, the film is volatilzed. Preferably, the film is thin and the organic material is volatilizable when heated in air at temperatures below about 400° C, so that it is easily removable by baking in the usual tube-making processes.

By coating the neck as the initial step in mount sealing according to the novel method, fewer particles are generated and/or liberated from the neck and the funnel coating during the inserting and sliding of the mount assembly in the neck. This provides fewer opportunities for troubles arising from the presence of such particles in the finished tube. Also, it has been observed that tubes made with the novel method experience less arcing on the average during electrode treatment and aging in the finished tubes. Also, breakage of glass during subsequent thermal cycling is reduced.

BRIEF DESCRIPTION OF THE DRAWINGS

FIG. 1 is a flow-sheet diagram illustrating the novel method including coating the inner surface of the neck of a cathode-ray tube prior to sealing the mount assembly in the neck of a cathode-ray tube.

FIG. 2 is a partially-schematic, elevational view of a portion of a conveyer where the necks of a series of cathode-ray tubes are coated by dipping.

FIG. 3 is a fragmentary longitudinal sectional view of a neck at the time that the mount assembly is being slid into position therein.

FIG. 4 is a transverse sectional view of the neck shown in FIG. 3 at section lines 4—4.

DETAILED DESCRIPTION OF THE PREFERRED EMBODIMENTS

A detailed description of a cathode-ray tube and the method of sealing the mount assembly therein need not be given here since these details are already described in the prior art; for example, in the above-cited patents to C. G. Reynard and J. F. Segro et al. However, the process will be briefly described with respect to FIGS. 1, 2 and 3.

A luminescent screen is fabricated on the inner surface of a faceplate panel. In the case of a tricolor screen for a color television picture tube, the luminescent picture elements may be fabricated by photodeposition, after which a specular metal layer, such as a layer of aluminum, is deposited thereon. The inner surface of a funnel with a neck sealed thereto is selectively coated with an internal electrically-conducting coating comprising, for example, graphite, iron oxide and a silicate binder. Then, the panel is sealed to the funnel, for example, with a devitrifying frit as is known in the art. The resulting panel-funnel assembly is now ready for mount sealing.

The inner surface of the neck 19 of the tube is now coated with a film of volatilizable material as shown by box 11 of FIG. 1. In the preferred coating method shown in FIG. 2, tubes 21 are loaded in series, neck down, on holders 23 of an overhead conveyer 25. As shown in FIG. 2, the holders 23 pass from left to right in the direction of the arrow 26. An open dip tank 27 containing an aqueous solution 28 of polyvinyl alcohol (0.5 weight percent concentration) is located at a station along the conveyer. The conveyer dips the neck of the tube 21 down into the emulsion to the desired depth. In one practice of the process, the neck remains immersed for about 10 seconds, and then the conveyer raises the neck out of the solution and passes over a drip tank 29 where the neck is permitted to drain by gravity free of excess solution. The residual coating on the neck is then permitted to dry in air on its way to the mount-sealing machine. Drying may be forced by heat and/or an air draft if desired.

At the mount-sealing machine (not shown), the panel-funnel assembly is placed on a rotatable assembly as shown, for example, in the above-cited Segro et al patent. The mount assembly is pushed into the neck 19 of the tube, positioned on a mount pin (not shown) and rotationally oriented with respect to the screen. The mount assembly includes a convergence cup 31 and bulb spacers 33 (spring-like fingers) mounted thereon as shown in FIG. 3. The mount assembly includes also an antenna getter comprising a flat spring 35 attached at one end 37 to the convergence cup 31 and having a getter container 39 attached to the other end 41. There are sled-like runners 43 attached to the bottom of the getter container 39 as shown in FIGS. 3 and 4.

After the mount assembly is rotationally oriented, the mount assembly is slid into the neck 45 of the tube in the direction of the arrow 47. This step is indicated by box 13 of FIG. 1. At this stage of manufacture, the neck 19 has a flare 49 to make it easier to receive the mount assembly and particularly the getter container 39 and the bulb spacers 33 therein. All spring-like members are being urged outward against the inner wall 45 of the neck 19 by spring pressure. As the mount assembly is moved in the direction of the arrow 47, the runners 43 and the bulb spacers 33 slide on the inner wall 45 of the neck 19 and then on the conductive coating 51. The combination of outward pressure and sliding, in prior-art mount-insertion procedures, ordinarily produces a substantial number of particles and sometimes scratches on the surfaces. However, due to the presence of the film of organic material, the surfaces are not scratched and few or no particles are produced. Also, glass breakage during subsequent thermal cycling due to scratches in the glass is reduced.

When the mount assembly is in its desired spacing and rotational orientation with respect to the screen, the mount assembly at its glass-stem portion is sealed to the neck 19 and excess glass neck material including the flare 49 is removed, as indicated by the box 15 of FIG. 1. Subsequently, the tube is baked and exhausted of gases, as described, for example, in U.S. Pat. No. 3,922,049 to F. S. Sawicki, and then sealed from the atmosphere. In a typical bake-and-exhaust cycle, the neck reaches about 360° C and is at or above about 335° C for about 5 to 6 minutes. During this period, any residual film in the neck is volatilized as indicated by the box 17 of FIG. 1. Subsequently, the electrodes of the sealed-off tube are subjected to various electrical treatments such as, for example, are described in U.S. Pat. No. 3,966,287 to P. R. Liller. During such electrical treatments, considerable arcing is normally observed, and the arc count (number of arcs per tube) is considered to be a measure of the tube's stability. Surprisingly and not yet fully understood, tubes made according to the novel method exhibit a lower arc count and are considered to be more stable electrically than similar tubes made without coating the neck. In one set of tests, the average arc count over 72 hours dropped from about 11.5 to 2.3 for 25V-110° delta-gun tubes, and from about 16.9 to 3.8 for 25-110° in-line-gun tubes.

The novel method has been described by dipping the neck of the tube into an 0.5 weight percent polyvinyl alcohol solution. However, any method of coating may be used, for example, spraying and flow coating. Also, the concentration of the film-forming material in the coating formulation is not critical. In the case of polyvinyl alcohol, the solution may contain 0.1 to 1.0 weight percent polyvinyl alcohol. It is preferred that the organic film be as thin as possible so that the amounts of material to be volatilized and the amount of residue are minimized.

Any organic film-forming material which is removable by volatilization at temperatures below about 400° C and leaves no residue, or leaves a residue which is chemically stable in a vacuum, may be used. Polymers, such as polyvinyl acetates and polyvinyl alcohols, are preferred. However, other organic film-forming materials such as acrylics, long-chain fatty acids, organic soaps, glycols and polyglycols may be used. It has been suggested that the film-forming material should be lubricious. However, this characteristic has not correlated with either the reduced amount of particles generated or the reduced arc count. The coating should extend over all of the areas of the neck over which the getter container and the bulb spacers will slide. This may include a portion of the funnel coating.

The film may be volatilized during the bake-and-exhaust cycle as described above. Or, the film may be volatilized during the step of sealing the glass stem of the mount assembly to the neck of the tube. This is easily achieved by providing an auxiliary heater on the sealing machine to raise the neck to the desired temperature. Or, the film may be volatilized in a separate heating step between the mount-sealing and bake-and-exhaust steps.

We are aware that it is old to coat the outside surfaces of glass containers to improve their resistance to scratching. See, for example, U.S. Pat. Nos. 3,441,399 to L. Levine et al and 3,801,361 to W. Kitaj. These are substantially permanent coatings whose purpose is to prevent scratches that are easily seen by the naked eye. The novel method reduces scratches in inside surfaces, which scratches are grossly smaller than those referred to in the above-cited patents. These slight scratches are more like surface disturbances and are barely visible at best. But, however slight, they may have a large effect, being sources of particles and/or surface sites which may degrade the performance of the cathode-ray tube. The coatings employed in the novel method also differ in that they do not include inorganic constituents, they must be volatilizable when heated in air at temperatures below about 400° C, and they must leave no residue which is chemically unstable in a vacuum.

We claim:

1. In a method for sealing a mount assembly in the neck of a cathode-ray tube having a faceplate panel and a luminescent screen thereon, the steps in the following order:

a. coating the inner surface of said neck with a film of organic material which is volatilizable when heated in air at temperatures below about 400° C, b. sliding said mount assembly into said neck to a perdetermined oriented and spaced position with respect to said screen, c. sealing said mount assembly into said neck, d. and volatilizing said film.

2. The method defined in claim 1 wherein said organic material is polyvinyl alcohol.

3. The method defined in claim 2 wherein said film is produced by dipping said neck in an aqueous solution containing 0.1 to 1.0 weight percent polyvinyl alcohol, permitting excess solution to drain from said neck, and then drying the residue to produce said film.

4. In a method for manufacturing a cathode-ray tube comprising a faceplate panel, a luminescent viewing screen supported on the inner surface of said panel, a funnel connected at its larger opening end to said panel, a neck connected to the smaller opening end of said funnel, and a mount assembly sealed in said neck, the steps in the following order:

a. coating the inner surface of said neck with a film of organic polymeric material, which polymeric material is volatilizable when heated in air at temperatures below about 400° C, b. inserting said mount assembly into said neck, c. sliding said mount assembly in said neck to a predetermined rotationally oriented and axially spaced position with respect to said screen, d. sealing said mount assembly into said neck, e. and heating said neck in air at temperatures sufficient to volatilize said film.

5. The method defined in claim 4 wherein step (a) is conducted by dipping said neck into a liquid composition consisting essentially of said organic polymeric material in an aqueous medium, permitting excess liquid to drain from said neck, and then drying the residue.

6. The method defined in claim 4 wherein step (a) is conducted by dipping said neck into an aqueous solution of polyvinyl alcohol.

7. The method defined in claim 6 wherein said polyvinyl alcohol constitutes about 0.1 to 1.0 weight percent of said solution.

8. The method defined in claim 6 wherein said polyvinyl alcohol constitutes about 0.5 weight percent of said solution.

* * * * *